US012130029B2

(12) United States Patent
Zhong et al.

(10) Patent No.: US 12,130,029 B2
(45) Date of Patent: Oct. 29, 2024

(54) FLOOR-TYPE AIR-CONDITIONING INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Zhiyao Zhong, Guangdong (CN); Chao Cheng, Guangdong (CN); Jielin Peng, Guangdong (CN); Sun Gong, Guangdong (CN); Bo Wang, Guangdong (CN); Xin Chen, Guangdong (CN); Hejie Zhou, Guangdong (CN); Kailong Li, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 371 days.

(21) Appl. No.: 17/697,151

(22) Filed: Mar. 17, 2022

(65) Prior Publication Data

US 2022/0205651 A1 Jun. 30, 2022

Related U.S. Application Data

(63) Continuation of application No. PCT/CN2020/078638, filed on Mar. 10, 2020.

(30) Foreign Application Priority Data

Oct. 23, 2019 (CN) ..... 201911014783.8
Oct. 23, 2019 (CN) ..... 201921792235.3

(51) Int. Cl.
*F24F 1/028* (2019.01)

(52) U.S. Cl.
CPC ..... *F24F 1/028* (2019.02)

(58) Field of Classification Search
CPC ..... F24F 1/028; F24F 1/0284; F24F 1/0287; F24F 1/029; F24F 1/03; F24F 1/0003; F24F 1/0007; F24F 1/0011; F24F 1/0014
See application file for complete search history.

(56) References Cited

U.S. PATENT DOCUMENTS

2017/0016634 A1* 1/2017 Lee ..... F24F 1/0014
2017/0097162 A1* 4/2017 Shin ..... F24F 1/0029
2024/0068696 A1* 2/2024 Kang ..... F24F 1/0035

FOREIGN PATENT DOCUMENTS

CN 201637054 U 11/2010
CN 201897302 U 7/2011
(Continued)

OTHER PUBLICATIONS

English translation of Zhong et al. (CN 103776147 A). (Year: 2014).*

(Continued)

*Primary Examiner* — Miguel A Diaz
(74) *Attorney, Agent, or Firm* — Scully, Scott, Murphy & Presser, P.C.

(57) ABSTRACT

A floor-type air-conditioning indoor unit and an air conditioner are provided. The indoor unit has a housing, a top air outlet frame and a fan assembly. The housing has an installation port where the top air outlet frame is installed. The top air outlet frame is movable in an up-down direction and has a lower port and a front port. The fan assembly blows airflow from the air inlet to the lower port and out from the front port of the top air outlet frame. One of the top air outlet frame and the housing is provided with a sliding plate extending in the up-down direction, and the other is provided with a sliding groove engaging the sliding plate. A (Continued)

length of the sliding plate is longer than or equal to a maximum trip of the top air outlet frame in the up-down direction.

17 Claims, 5 Drawing Sheets

(56) References Cited

FOREIGN PATENT DOCUMENTS

| | | | | |
|---|---|---|---|---|
| CN | 103776147 | A | * | 5/2014 |
| CN | 105202734 | A | | 12/2015 |
| CN | 206073412 | U | | 4/2017 |
| CN | 110567051 | A | | 12/2019 |
| CN | 210601958 | U | | 5/2020 |
| KR | 20040062777 | A | | 7/2004 |
| KR | 20050054182 | A | | 6/2005 |
| KR | 100904309 | B1 | | 6/2009 |
| KR | 20090098514 | A | | 9/2009 |
| KR | 20100053099 | A | | 5/2010 |

OTHER PUBLICATIONS

First Office Action dated Jan. 13, 2024 received in Chinese Patent Application No. CN 201911014783.8.
Request for the Submission of an Opinion dated Dec. 15, 2023 received in Korean Patent Application No. KR 10-2022-7009742.
International Search Report and Written Opinion dated Jul. 23, 2020 received in International Application No. PCT/CN2020/078638 together with an English language translation.

* cited by examiner

FLOOR-TYPE AIR-CONDITIONING INDOOR UNIT AND AIR CONDITIONER

CROSS REFERENCE TO RELATED APPLICATIONS

The present application is a continuation application of PCT International Application No. PCT/CN2020/078638, filed on Mar. 10, 2020, which claims the priority to and benefits of the Chinese patent applications Nos. 201911014783.8 and 201921792235.3, both titled "Floor-type Air-conditioning Indoor Unit and Air Conditioner" and filed on Oct. 23, 2019. The entire disclosures of the aforementioned applications are hereby incorporated by reference for all purposes. No new matter has been introduced.

FIELD

The present application relates to the field of air-conditioning equipment, in particular, to a floor-type air-conditioning indoor unit and an air conditioner.

BACKGROUND

At present, air conditioners generally have a single air supply form and a small air supply range, which does not meet the diversified needs of users. In order to realize various forms of air supply of air conditioners and increase the air supply range simultaneously, those skilled in the art began to study the air conditioner with top air outlet. For an air conditioner with a top air outlet, an installation port is generally set on the top of the air conditioner, and a top air outlet structure is movably installed at the installation port. However, the top air outlet structure is prone to swinging back and forth during moving up and down.

The above contents are only used to assist in understanding the technical solution of the present application, and do not mean to recognize that the above contents are prior art.

SUMMARY

The main purpose of the present application is to propose a floor-type air-conditioning indoor unit, which aims to prevent a top air outlet frame of the floor-type air-conditioning indoor unit from swinging back and forth during moving up and down.

In order to achieve at least the above purpose, the present application proposes a floor-type air-conditioning indoor unit, including:

- a housing defined with an air inlet and an installation port with an upward opening, an air duct being formed between the installation port and the air inlet;
- a top air outlet frame installed at the installation port and movable in an up-down direction and defined with a lower port and a front port; and
- a fan assembly installed in the air duct and configured to blow an airflow from the air inlet to the lower port of the top air outlet frame and out from the front port of the top air outlet frame;
- wherein one of the top air outlet frame and the housing is provided with a sliding plate extending in the up-down direction, and the other is provided with a sliding groove engaged with the sliding plate, a length of the sliding plate is longer than or equal to a maximum trip of the top air outlet frame moving in the up-down direction.

Optionally, the length of the sliding plate is less than or equal to twice the maximum trip of the top air outlet frame moving in the up-down direction.

Optionally, the housing includes an outer housing and an air duct housing installed in the outer housing, the installation port is formed on a top surface of the air duct housing, and the air duct is formed inside the air duct housing.

Optionally, the sliding plate is provided on the top air outlet frame, and the sliding groove is defined on an inner wall of the air duct housing.

Optionally, the top air outlet frame has two opposite side plates and two sliding plates, and the two sliding plates are respectively connected with the two side plates and extended downwards.

Optionally, the floor-type air-conditioning indoor unit further includes a sliding rail detachably installed on the sliding plate.

Optionally, the sliding rail is defined with a first screw hole, and the sliding plate is defined with a second screw hole corresponding to the first screw hole, and the sliding rail is fixed with the sliding plate by a screw inserted to the first screw hole and the second screw hole.

Optionally, the sliding rail is provided with a positioning hole, and the sliding plate is provided with a positioning column engaged with the positioning hole.

Optionally, a front side of the outer housing is provided with an air outlet located below the top air outlet frame, the air duct housing is provided with an air opening corresponding to the air outlet, and the fan assembly is also provided to drive the airflow to the air opening and blow out from the air outlet.

Optionally, the top air outlet frame has a first position extending out of the installation port and a second position hidden in the air duct housing.

Optionally, the floor-type air-conditioning indoor unit further includes a driving device installed on the air duct housing, and the driving device is connected with the top air outlet frame to drive the top air outlet frame to move between the first position and the second position.

The present application also proposes an air conditioner, including:

- a floor-type air-conditioning outdoor unit; and
- a floor-type air-conditioning indoor unit connected with the floor-type air-conditioning outdoor unit through a refrigerant pip.

The floor-type air-conditioning indoor unit of the present application adopts a top air outlet frame installed at the installation port of the housing. The top air outlet frame is provided with a lower port and a front port. The airflow is blown from the air inlet to the lower port of the top air outlet frame by the fan assembly and out from the front port of the top air outlet frame, so as to realize to blow air from the top of the floor-type air-conditioning indoor unit and increase the air supply range. At the same time, the top air outlet frame can move up and down, so as to change a height of the top air outlet frame, and further change the air supply range of the top air outlet frame. In addition, one of the top air outlet frame and the housing is provided with a sliding plate extending in the up-down direction, and the other is provided with a sliding groove engaged with the sliding plate, and a length of the sliding plate is longer than or equal to the maximum trip of the top air outlet frame in the up-down direction, thus it can also effectively prevent the top air outlet frame from swinging back and forth during moving up and down, and avoid the generation of noise.

BRIEF DESCRIPTION OF THE DRAWINGS

In order to more clearly explain the embodiments of the present application or the technical solutions in the related art, the following will briefly introduce the drawings needed in the embodiments or the description of the prior art. It is obvious that the drawings in the following description are only some embodiments of the present application. For those skilled in the art, other drawings can also be obtained according to the structure shown in these drawings, without paying creative labor.

DETAILED DESCRIPTION OF EMBODIMENTS

Figure 1:
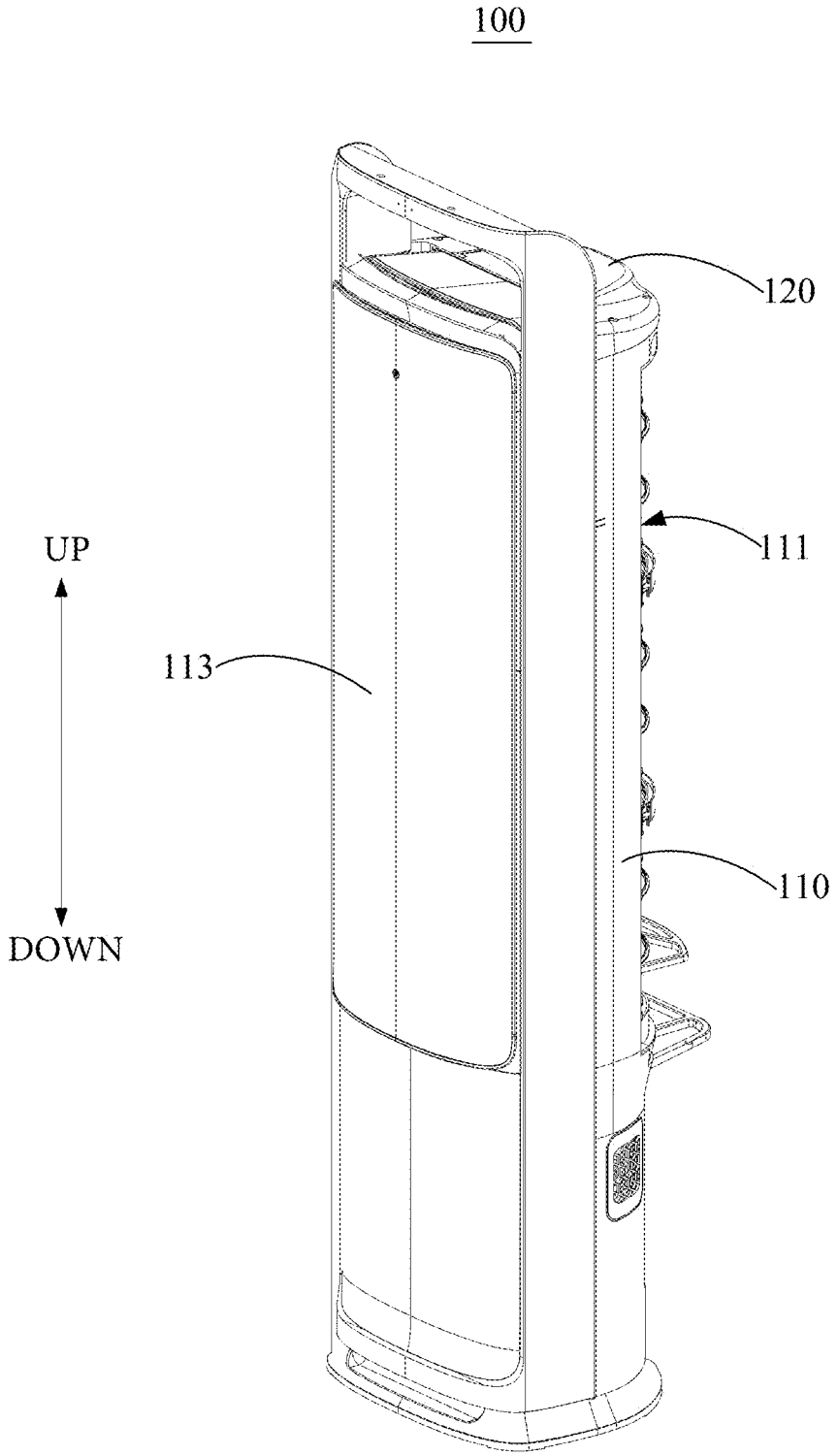
FIG. 1 is a structural view of a floor-type air-conditioning indoor unit according to an embodiment of the present application.

It should be noted that if the embodiment of the present application involves a directional indication (such as up, down, left, right, front, rear . . . ), the directional indication is only used to explain the relative position relationship, movement, etc. among components in a specific posture (as shown in the attached drawings). If the specific posture changes, the directional indication will change accordingly. In addition, "and/or" in the full text includes three parallel schemes. Taking "A and/or B" as an example, "A and/or B" includes scheme A, or scheme B, or both schemes A and B.

The present application provides a floor-type air-conditioning indoor unit.

Referring to FIGS. 1 to 5, the present application proposes a floor-type air-conditioning indoor unit 100. The floor-type air-conditioning indoor unit includes a housing 110, a top air outlet frame 120 and a fan assembly. The housing 110 is provided with an air inlet 111, and an installation port with an upward opening. An air duct is formed between the installation port and the air inlet 111. The top air outlet frame 120 is installed at the installation port and movable in an up-down direction, and is provided with a lower port 121 and a front port 122. The fan assembly is installed in the air duct and configured to blow airflow from the air inlet 111 to the lower port 121 of the top air outlet frame 120 and out from the front port 122 of the top air outlet frame 120. One of the top air outlet frame 120 and the housing 110 is provided with a sliding plate 150 extending in the up-down direction, and the other is provided with a sliding groove 140 engaged with the sliding plate 150. A length of the sliding plate 150 is longer than or equal to the maximum trip of the top air outlet frame 120 in the up-down direction.

In this embodiment of the present application, a rear side of the housing 110 is provided with an air inlet 111, and a front side of the housing 110 is provided with an air outlet 112 located below the top air outlet frame 120. It is not generalizable that an air outlet grille is installed at the air outlet 112. An upper end of the housing 110 is provided with an installation port with an upward opening for the installation of the top air outlet frame 120. Here, it should be noted that the housing 110 includes an outer housing and an air duct housing installed in the outer housing, the installation port is formed on a top surface of the air duct housing, that is, the installation port is provided on the top surface of the air duct housing, and the air duct is formed inside the air duct housing. Meanwhile, the front side of the outer housing is provided with the air outlet 112, the air duct housing is provided with a first air opening corresponding to the air outlet 112, the rear side of the housing is provided with the air inlet 111, and the air duct housing is provided with a second air opening corresponding to the air inlet 111. Of course, it is not limited to this. The housing 110 can also only include the outer housing, the installation port is formed on the top surface of the outer housing (that is, the installation port is provided on the top surface of the outer housing), and the air duct is formed inside the outer housing.

The top air outlet frame 120 can be installed at the installation port and moveable up and down, and has a maximum trip in the up-down direction. For ease of understanding, the highest position of the top air outlet frame 120 in the up-down direction can be defined as the first position, and the lowest position of the top air outlet frame 120 in the up-down direction can be defined as the second position. The top air outlet frame 120 can move between the first position and the second position in the up-down direction. Here, it should be noted that the first position and the second position are not specifically limited. For example, the top air outlet frame 120 has a first position and a second position both extending out of the installation port. When the top air outlet frame 120 is located at the first position, at the second position or at any position between the first position and the second position, the top air outlet frame 120 can be always out of the installation port, that is, the top air outlet frame 120 is exposed from the housing 110. At this time, the top air outlet frame 120 moves between the first position and the second position to change the height of the top air outlet frame 120, thereby changing the air supply range of the top air outlet frame 120.

For another example, the top air outlet frame 120 has a first position extending out of the installation port and a second position hidden in the air duct housing. When the top air outlet frame 120 is located at the first position, the top air outlet frame 120 extends out of the installation port. When the top air outlet frame 120 is located at the second position, the top air outlet frame 120 is hidden in the air duct housing. At this time, the top air outlet frame 120 is still located above the air outlet 112. In this way, when the user needs the top air outlet of the floor-type air-conditioning indoor unit 100, the top air outlet frame 120 can be moved above the installation port, so that the airflow can be blown out through the front port 122 of the top air outlet frame 120 to increase the air supply range. When the user does not need the top air outlet of the floor-type air-conditioning indoor unit 100, the top air outlet frame 120 can be moved below the installation port, that is, the top air outlet frame 120 can be stored in the air duct housing, such that the floor-type air-conditioning indoor unit 100 has a variety of air outlet modes, which can better meet the diversified needs of users.

Figure 3:
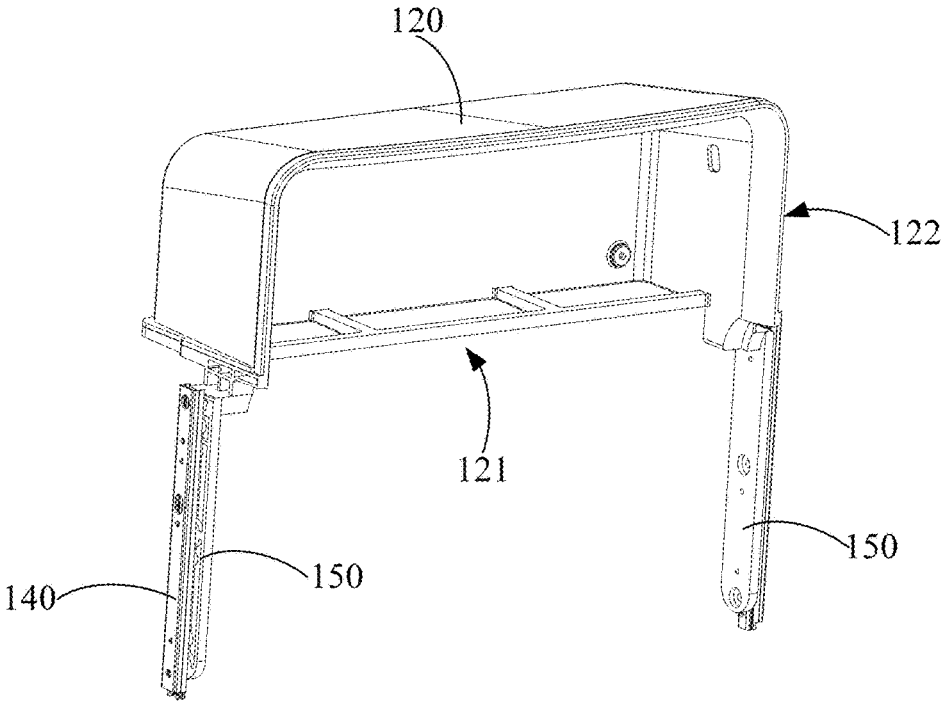
FIG. 3 is a structural view of a top air outlet frame in FIG. 1.

The structure and shape of the top air outlet frame 120 can be various without specific limitation. For example, but it is not limited to this, in one embodiment, the top air outlet frame 120 includes a substantially U-shaped frame plate and a rear end plate provided at the rear end of the frame plate (as shown in FIG. 3). The lower end and the front end of the top air outlet frame 120 are open, that is, the lower port 121 of the top air outlet frame 120 is an air inlet port, and the front port 122 of the top air outlet frame 120 is an air outlet port, such that the airflow can flow in from the lower port 121 (the air inlet port) of the top air outlet frame 120 and blow out from the front port 122 (the air outlet port) of the top air outlet frame 120. It can be understood that the fan assembly is mainly provided to blow the airflow from the air inlet 111 to the lower port 121 of the top air outlet frame 120 and out from the front port 122 of the top air outlet frame 120. For the indoor unit with an air duct housing, the fan assembly is also configured to drive the airflow to the first air opening and blow out from the air outlet 112. The combination form of the fan assembly will be described in detail below and will not be repeated here.

In the embodiment of the present application, in order to better drive the top air outlet frame 120 to move between the first position and the second position, one of the top air outlet frame 120 and the housing 110 can be provided with a sliding plate 150 extending in the up-down direction, and the other can be provided with a sliding groove 140 engaged with the sliding plate 150. Considering that the top air outlet frame 120 may swing back and forth during moving up and down and thus significant noise is produced, the length of the sliding plate 150 can be greater than or equal to the maximum trip of the top air outlet frame 120 in the up-down direction to prevent the top air outlet frame 120 from swinging back and forth during moving up and down and avoid the generation of noise. Here, the maximum trip refers to the one-way trip of the top air outlet frame 120 moving from the first position to the second position, that is, a distance between the first position and the second position.

The floor-type air-conditioning indoor unit 100 of the present application adopts a top air outlet frame 120 installed at the installation port of the housing 110, the top air outlet frame 120 is provided with a lower port and a front port 122, the airflow is blown from the air inlet 111 to the lower port 121 of the top air outlet frame 120 through the fan assembly, and out from the front port 122 of the top air outlet frame 120, so as to realize blowing air out from the top of the floor-type air-conditioning indoor unit 100 and increase the air supply range. At the same time, the top air outlet frame 120 can move between the first position and the second position in the up-down direction, so as to change the height of the top air outlet frame 120, and further change the air supply range of the top air outlet frame 120. In addition, one of the top air outlet frame 120 and the housing 110 is provided with a sliding plate 150 extending in the up-down direction, and the other is provided with a sliding groove 140 engaged with the sliding plate 150, and a length of the sliding plate 150 is longer than or equal to the maximum trip of the top air outlet frame 120 in the up-down direction, such that it can also effectively prevent the top air outlet frame 120 from swinging back and forth during moving up and down, and avoid the generation of noise.

In one embodiment, a length of the sliding rail 130 is less than or equal to twice the maximum trip of the top air outlet frame 120 in the up-down direction. For example, the length of the sliding rail 130 is L, and the maximum trip of the top air outlet frame 120 in the up-down direction is S, where $S \leq L \leq 2S$.

It should be noted that if $L<S$, the length of the sliding plate 150 is overly short to prevent the top air outlet frame 120 from swinging back and forth during moving up and down. If $L>2S$, the length of the plate 150 is overly long, so it is necessary to increase the overall height of the floor-type air-conditioning indoor unit 100, which is not conducive to making the internal structure of the floor-type air-conditioning indoor unit 100 more compact and thus leads to waste of installation space. Therefore, in this embodiment, by setting $S \leq L \leq 2S$, it can more effectively prevent the top air outlet frame 120 from swinging forth and back during moving up and down, and at the same time, the internal structure of the floor-type air-conditioning indoor unit 100 can be more compact and the installation space can be saved.

Figure 4:
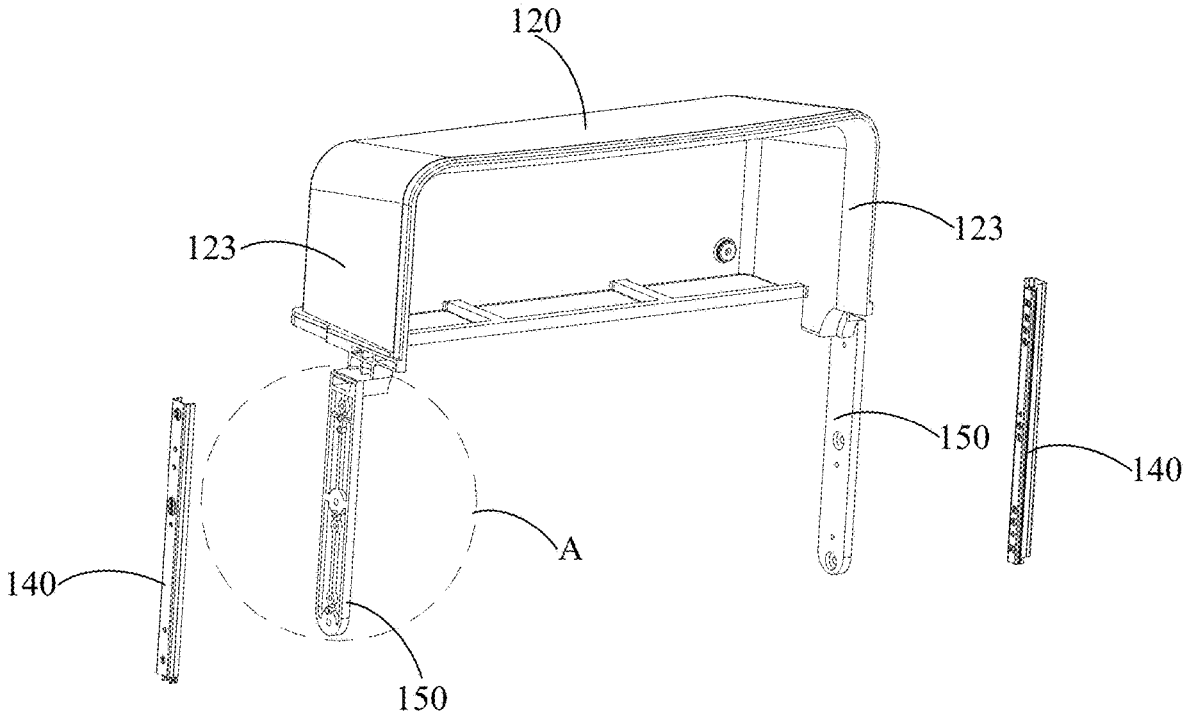
FIG. 4 is an exploded view of the top air outlet frame in FIG. 1.

Referring to FIG. 3 and FIG. 4, in one embodiment, the sliding plate 150 is provided on the top air outlet frame 120, and the sliding groove 140 is provided on an inner wall of the air duct housing. Alternatively, in other embodiments, the sliding plate 150 can also be provided on the inner wall of the air duct housing, and the sliding groove 140 is provided on the top air outlet frame 120.

The number of the sliding rails 130 and the number of the sliding grooves 140 are not specifically limited, and can be set according to actual needs. In this embodiment, in order to make the top air outlet frame 120 move up and down more stably and avoid the top air outlet frame 120 from swinging left and right, both the number of the sliding plates 150 and the number of the sliding grooves 140 can be two. For example, the air outlet frame 120 has opposite two side plates 123, the two sliding plates 150 are respectively connected with the two side plates 123 of the top air outlet frame 120 and extend downward, and the two sliding grooves 140 are respectively provided on the inner wall of the air duct housing to cooperate with the two sliding rails 130.

In addition, there can be a variety of connection modes between the sliding rails 130 and the top air outlet frame 120. For example, the sliding rails 130 can be detachably connected with the top air outlet frame 120, or the sliding rails 130 are integrally formed with the top air outlet frame 120.

Figure 5:
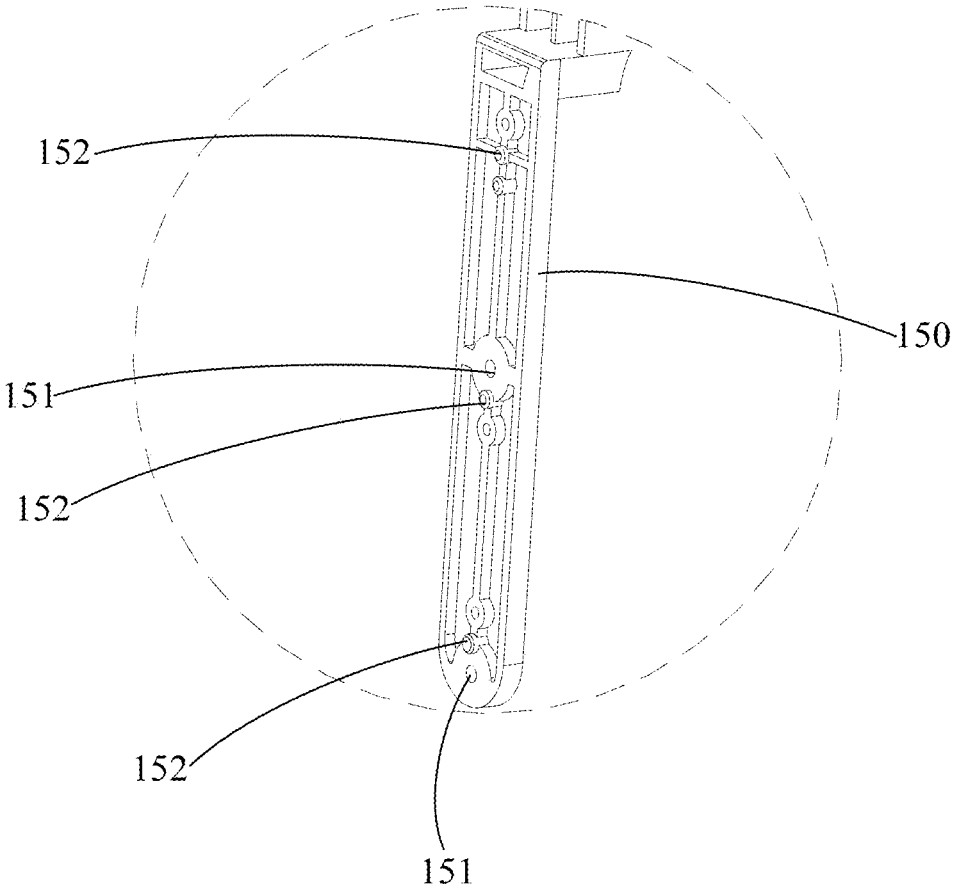
FIG. 5 is an enlarged view of portion A in FIG. 4.
Figure 6:
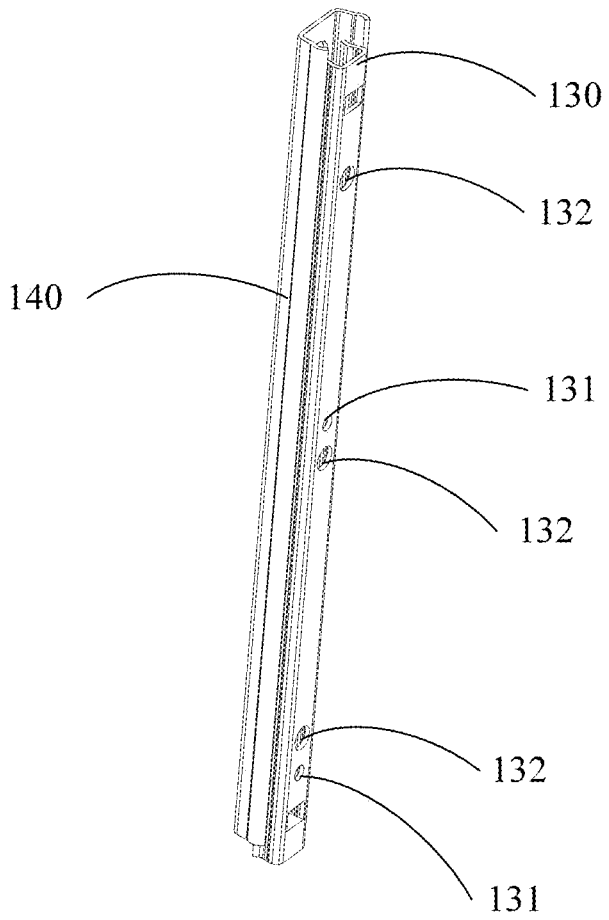
FIG. 6 is a structural view of a sliding rail and a sliding groove in FIG. 3.

Referring to FIG. 4, FIG. 5 and FIG. 6, in one embodiment, the floor-type air-conditioning indoor unit 100 also includes a sliding rail 130, which is detachably installed on the sliding plate 150. The sliding rail 130 and the sliding plate 150 can be detachably connected in a variety of ways, such as screw connection, snap connection or adhesive connection, etc. In this embodiment, the sliding rail 130 and the sliding plate 150 are fixed by screw connection. For example, the sliding rail 130 is provided with a first screw hole 131, and the sliding plate 150 is provided with a second screw hole 151 corresponding to the first screw hole 131. The sliding rail 130 and the sliding plate 150 are fixed by inserting a screw into the first screw hole 131 and the second screw hole 151, however, it is not limited to this.

Further, in order to fix the sliding rail 130 and the sliding plate 150 quickly and accurately, a positioning hole 132 can be provided on the sliding rail 130, and a positioning column 152 engaged with the positioning hole 132 can be provided on the sliding plate 150. In this way, through a cooperation between the positioning hole 132 and the positioning column 152, the first screw hole 131 and the second screw hole 151 can be aligned readily in the process of fixing the sliding rail 130 and the sliding plate 150 to facilitate screw fixing.

It can be understood that in order to better drive the top air outlet frame 120 to move between the first position and the second position, the floor-type air-conditioning indoor unit 100 also includes a driving device installed on the air duct housing, and the driving device is connected with the top air outlet frame 120 to drive the top air outlet frame 120 to move between the first position and the second position. Alternatively, the top air outlet frame 120 can also be manually driven to move between the first position and the second position. The driving device can include a motor, a cylinder, or the like.

Figure 2:
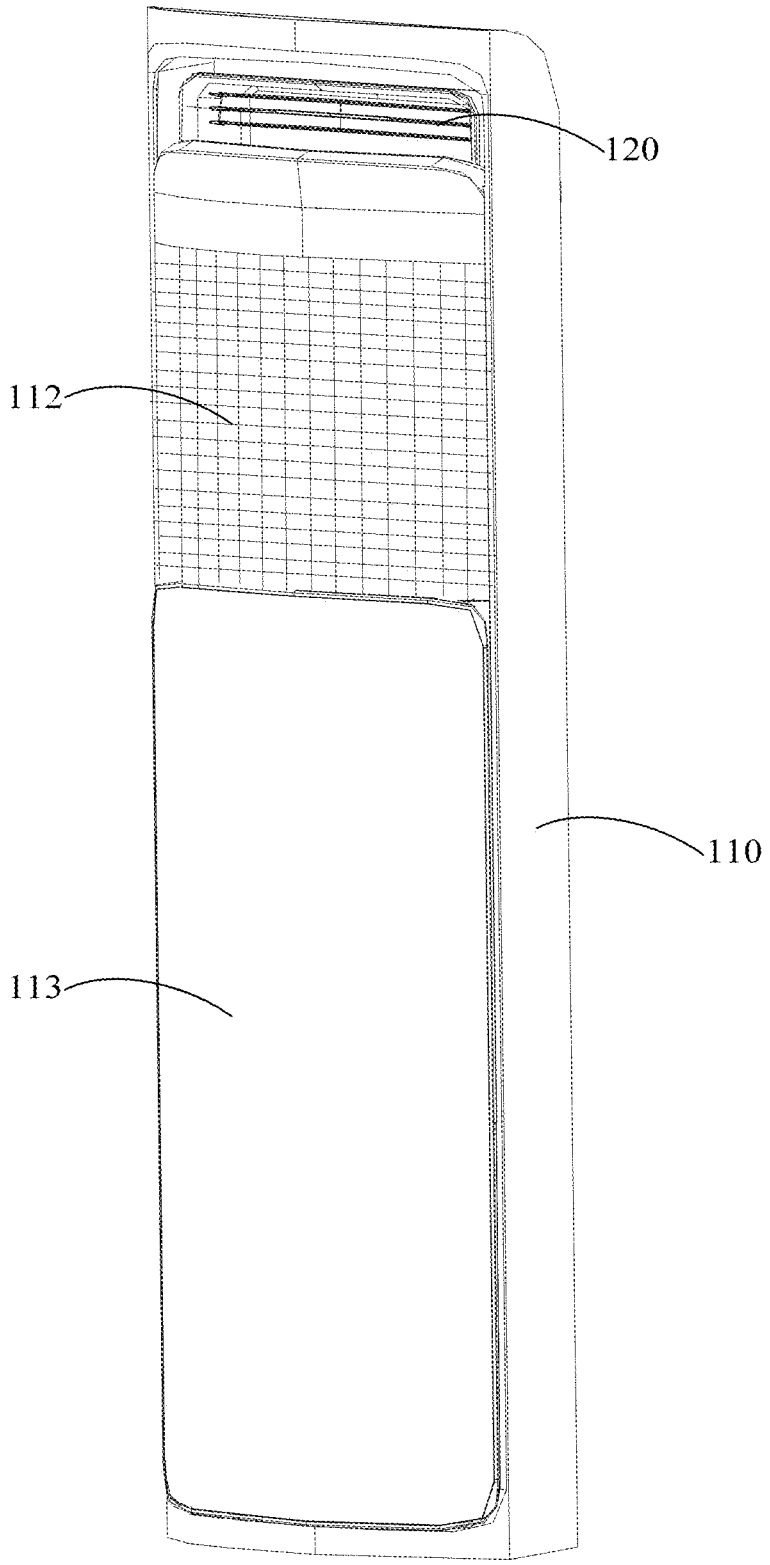
FIG. 2 is a structural view of the floor-type air-conditioning indoor unit according to another embodiment of the present application.

Referring to FIG. 1 and FIG. 2, on the basis of the above embodiments, the floor-type air-conditioning indoor unit also includes a sliding door 113, which can be installed at the air outlet 112 and slidable in the up-down direction to open or close the air outlet 112.

The present application also proposes an air conditioner, which includes a floor-type air-conditioning outdoor unit and a floor-type air-conditioning indoor unit. 100. The specific structure of the floor-type air-conditioning indoor unit 100 refers to the above embodiments. Since the air conditioner adopts all the technical solutions of all the above embodiments, it has at least all the beneficial effects brought by the technical solutions of the above embodiments, which will not be repeated here. The floor-type air-conditioning indoor unit 100 is connected with the floor-type air-conditioning outdoor unit through a refrigerant pipe.

The above is only an optional embodiment of the present application and does not limit the scope of the patent of the present application. Under the inventive concept of the present application, any equivalent structural transformation made by using the contents of the description and drawings of the present application, or any directly/indirectly application in other relevant technical fields, is included in the claimed scope of the present application.

What is claimed is:

1. A floor air-conditioning indoor unit comprising:

a housing provided with an air inlet and an installation port having an upward opening, an air duct being formed between the installation port and the air inlet;

a top air outlet frame at the installation port and movable in an up-down direction and provided with a lower port and a front port;

a fan assembly in the air duct and configured to blow airflow from the air inlet to the lower port of the top air outlet frame and out from the front port of the top air outlet frame;

a sliding groove provided to the housing and extending in the up-down direction;

a sliding plate provided to the top air outlet frame; and a sliding rail detachably provided to the sliding plate and configured to be moved in the up-down direction while engaged by the sliding groove, wherein a length of the sliding plate is longer than or equal to a maximum trip of the top air outlet frame moving in the up-down direction; and wherein the sliding rail is provided with a positioning hole, and the sliding plate is provided with a positioning column engaged with the positioning hole.

2. The floor air-conditioning indoor unit according to claim 1, wherein the length of the sliding plate is less than or equal to twice the maximum trip of the top air outlet frame moving in the up-down direction.

3. The floor air-conditioning indoor unit according to claim 1, wherein the housing comprises an outer housing and an air duct housing in the outer housing, the installation port is formed on a top surface of the air duct housing, and the air duct is formed inside the air duct housing.

4. The floor air-conditioning indoor unit according to claim 3, wherein the sliding groove is defined in an inner wall of the air duct housing.

5. The floor air-conditioning indoor unit according to claim 4, wherein the top air outlet frame comprises two opposite side plates and two sliding plates, and wherein the two sliding plates are respectively connected with the two side plates and extend downwards.

6. The floor air-conditioning indoor unit according to claim 1, wherein the sliding rail is provided with a first screw hole, and the sliding plate is provided with a second screw hole corresponding to the first screw hole, and the sliding rail is fixed with the sliding plate by a screw inserted in the first screw hole and the second screw hole.

7. The floor air-conditioning indoor unit according to claim 3, wherein:

wherein a front side of the outer housing is provided with an air outlet located below the top air outlet frame, wherein the air duct housing is provided with an air opening corresponding to the air outlet, and wherein the fan assembly is further configured to drive the airflow to the air opening and blow out from the air outlet.

8. The floor air-conditioning indoor unit according to claim 3, wherein two ends of the maximum trip of the top air outlet frame in the up-down direction includes a first position and a second position, and wherein the first position extends out of the installation port and the second position is hidden in the air duct housing.

9. The floor air-conditioning indoor unit according to claim 8, further comprising a driving device on the air duct housing, wherein the driving device is connected with the top air outlet frame and configured to drive the top air outlet frame to move between the first position and the second position.

10. An air conditioner comprising:

a floor air-conditioning outdoor unit; and a floor air-conditioning indoor unit connected with the floor air-conditioning outdoor unit through a refrigerant pipe, the floor air-conditioning indoor unit comprising:

a housing provided with an air inlet and an installation port with an upward opening, an air duct being formed between the installation port and the air inlet;

a top air outlet frame at the installation port and movable in an up-down direction and defined with a lower port and a front port;

a fan assembly in the air duct and configured to blow airflow from the air inlet to the lower port of the top air outlet frame and out from the front port of the top air outlet frame;

a sliding groove provided to the housing and extending in the up-down direction;

a sliding plate provided to the top air outlet frame; and a sliding rail detachably provided to the sliding plate and configured to be moved in the up-down direction while engaged by the sliding groove, wherein a length of the sliding plate is longer than or equal to a maximum trip of the top air outlet frame moving in the up-down direction, and wherein the sliding rail is provided with a positioning hole, and the sliding plate is provided with a positioning column engaged with the positioning hole.

11. The air conditioner according to claim 10, wherein the length of the sliding plate is less than or equal to twice the maximum trip of the top air outlet frame moving in the up-down direction.

12. The air conditioner according to claim 10, wherein the housing comprises an outer housing and an air duct housing in the outer housing, the installation port is formed on a top surface of the air duct housing, and the air duct is formed inside the air duct housing.

13. The air conditioner according to claim 12,
wherein the sliding groove is provided on an inner wall of the air duct housing.

14. The air conditioner according to claim 13,
wherein the top air outlet frame comprises two opposite side plates and two sliding plates, and
wherein the two sliding plates are respectively connected with the two side plates and extend downwards.

15. The air conditioner according to claim 12,
wherein the front side of the outer housing is provided with an air outlet under the top air outlet frame,
wherein the air duct housing is provided with an air opening corresponding to the air outlet, and
wherein the fan assembly is further configured to drive the airflow to the air outlet and blow out from the air outlet.

16. The air conditioner according to claim 12,
wherein two ends of the maximum trip of the top air outlet frame in the up-down direction includes a first position and a second position, and
wherein the first position extends out of the installation port and the second position is hidden in the air duct housing.

17. The air conditioner according to claim 16,
wherein the floor air-conditioning indoor unit further comprises a driving device on the air duct housing, and
wherein the driving device is connected with the top air outlet frame and configured to drive the top air outlet frame to move between the first position and the second position.

* * * * *